US010494772B1

(12) United States Patent
Boston et al.

(10) Patent No.: US 10,494,772 B1
(45) Date of Patent: Dec. 3, 2019

(54) CONTROL SYSTEM FOR A PAVING MACHINE

(71) Applicant: Caterpillar SARL, Geneva (CH)

(72) Inventors: Timothy Boston, Washington, IL (US); Andrea Fontana, Porto Tolle-Rovido (IT)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/976,074

(22) Filed: May 10, 2018

(51) Int. Cl.

| | |
|---|---|
| ***E01C 19/00*** | (2006.01) |
| ***E01C 19/17*** | (2006.01) |
| ***B05D 1/02*** | (2006.01) |
| ***E01C 19/48*** | (2006.01) |

(52) U.S. Cl.
CPC ..... *E01C 19/176* (2013.01); *B05D 1/02* (2013.01); *E01C 19/174* (2013.01); *E01C 19/48* (2013.01)

(58) Field of Classification Search
CPC ..... E01C 19/174; E01C 19/176; E01C 19/48; B05D 1/02
USPC ..... 404/101, 111, 118, 72, 84.05
See application file for complete search history.

(56) References Cited

U.S. PATENT DOCUMENTS

| | | | | |
|---|---|---|---|---|
| 4,695,186 | A * | 9/1987 | King | E01C 23/06 126/343.5 A |
| 4,944,632 | A * | 7/1990 | Dillingham | E01C 19/08 404/101 |
| 5,735,634 | A * | 4/1998 | Ulrich | E01C 19/48 404/102 |
| 7,484,911 | B2 | 2/2009 | Frelich | |
| 7,572,081 | B2 | 8/2009 | Buschmann | |
| 7,632,038 | B2 * | 12/2009 | Buschmann | E01C 19/48 404/101 |
| 8,061,931 | B2 | 11/2011 | Musil | |
| 8,282,312 | B2 | 10/2012 | Braddy et al. | |
| 9,689,117 | B2 | 6/2017 | Bartoszek | |
| 2015/0139729 | A1 * | 5/2015 | Graham | E01C 19/48 404/84.1 |
| 2016/0215459 | A1 | 7/2016 | Cunningham et al. | |
| 2017/0314214 | A1 * | 11/2017 | Christian | E01C 19/176 |
| 2018/0327023 | A1 * | 11/2018 | Buschmann | B62D 6/002 |

FOREIGN PATENT DOCUMENTS

| | | | |
|---|---|---|---|
| DE | 4101417 | A1 | 10/1991 |

* cited by examiner

*Primary Examiner* — Raymond W Addie

(57) ABSTRACT

A paving system includes a paving machine, a controller, and a control panel. The paving machine includes a machine frame, a drive assembly, and a paving material delivery assembly, which includes a hopper, a conveyor assembly, an auger, and a screed. The paving machine also includes an emulsion fluid delivery assembly, including a tank of emulsion fluid and a spray bar including a plurality of nozzles. The controller is wired or wirelessly coupled to the tank and the spray bar to control at least one of a temperature, pressure, or delivery rate of the emulsion fluid through the nozzles.

20 Claims, 4 Drawing Sheets

CONTROL SYSTEM FOR A PAVING MACHINE

TECHNICAL FIELD

The present disclosure relates generally to a road construction machine, and more particularly, to a control system for a paving machine.

BACKGROUND

The present disclosure relates to paving machines that are used in road surface construction and repairs. Paving machines are typically utilized to lay asphalt or other paving material. Paving often includes a tanker truck delivering a pre-coating tack, emulsion fluid, or other treatment fluid on the existing ground or road surface to aid in the bonding of the new pavement. Many tanker trucks and paver machines deliver a constant amount of the treatment fluid to the ground surface. The treatment fluid is also delivered in a single pattern. An operator of the paver machine may be unable to monitor or control the volume, angle, temperature and/or other aspects of the treatment fluid delivered to the ground surface.

U.S. Pat. No. 8,061,931, issued to Musil on Nov. 2, 2011 ("the '931 patent"), describes a pre-coating system and method for hot mix asphalt paving. The paving system uses an emulsion cart deployed ahead of a paver machine. The emulsion cart of the '931 patent is coupled to spray bars that spray an emulsion fluid on a ground surface before the paver machine delivers the paving material. The temperature and flow rate of the treatment fluid of the '931 patent is controlled by a control system computer and a network of sensors, controls, and monitors. However, the control of the operations is limited based on the user interface disclosed. Additionally, the controls, display, and monitoring capabilities of the control system are minimal. The paving machine of the present disclosure may solve one or more of the problems set forth above and/or other problems in the art. The scope of the current disclosure, however, is defined by the attached claims, and not by the ability to solve any specific problem.

SUMMARY

In one aspect, a paving system may include a paving machine, a controller, and a control panel. The paving machine may include a machine frame, a drive assembly, and a paving material delivery assembly, which may include a hopper, a conveyor assembly, an auger, and a screed. The paving machine also may include an emulsion fluid delivery assembly, including a tank of emulsion fluid and a spray bar including a plurality of nozzles. The controller may be wired or wirelessly coupled to the tank and the spray bar to control at least one of a temperature, pressure, or delivery rate of the emulsion fluid through the nozzles.

The paving system may include any of the following aspects. The spray bar may be positioned on an underside of the machine frame between at least two tracks and may be fluidly coupled to the tank to deliver the emulsion fluid to a ground surface. The controller may be operable to control a spray pattern of the emulsion fluid delivered through the spray bar. Each nozzle may be coupled to a nozzle controller, and each nozzle controller may be wired or wirelessly coupled to the controller to control the opening and closing of a valve in each nozzle to control the delivery of emulsion fluid through each nozzle. The paving system may further include one or more heaters positioned within the tank, and the controller may be operable to control the activation of the one or more heaters. The paving system may further include one or more pumps positioned at least partially within the tank to control the delivery of the emulsion fluid, and the controller may be operable to control the activation of the one or more pumps. The controller may be operably coupled to one or more sensors within the emulsion fluid delivery assembly in order to measure and display at least one of a compressor pressure, an emulsion tank level, and a temperature of the emulsion fluid in the tank. The controller may be configured to indicate unsafe pressures, temperatures, or other conditions on the control panel based on the measurements of the one or more sensors.

The paving system may further include one or more spray elements positioned on the machine frame, and the spray elements may be positioned between tracks and the auger. The one or more spray elements may be fluidly connected to the tank. The control panel may include a layout of nozzle indicators indicative of the positioning of the nozzles on the spray bar and the spray elements. The control panel may include one or more nozzle controls. The nozzle controls may be coupled to sets of nozzles and spray elements, and the nozzle controls may be operable to activate or deactivate the delivery of emulsion fluid through the sets of nozzles and spray elements. Each nozzle indicator may be operable to activate or deactivate the delivery of emulsion fluid through each individual nozzle and spray element.

The controller may be coupled to the drive assembly of the paving machine to receive information regarding the speed or direction of the paving machine. The controller may be configured to automatically modify the spray pattern of the emulsion fluid by controlling the activation of individual nozzles based on the information received regarding speed or direction of the paving machine. The paving machine may further include a supply of cleaning fluid, and the controller may be operable to control the delivery of the cleaning fluid through the emulsion fluid delivery assembly. The paving machine may also include an air compressor, and the controller may be operable to control the delivery of compressed air to the nozzles or through the emulsion fluid delivery assembly. The control panel may be mounted to a rear of the machine frame and may be positioned at an operator position on the screed. The control panel may be removably mounted on the machine frame.

In another aspect, an emulsion fluid delivery and control system for a paving machine may include a tank of emulsion fluid, including at least one pump and one or more heaters. The system may also include a spray bar fluidly connected to the tank and including a plurality of nozzles. The nozzles may be coupled to a nozzle controller and include a pneumatically controlled valve. The system may further include a controller, and the controller may be wired or wirelessly coupled to the tank to control at least one of a temperature, pressure, and delivery rate of the emulsion fluid to the spray bar. The controller may be wired or wirelessly coupled to the plurality of nozzles to control the activation and deactivation of each nozzle.

The system may further include any of the following aspects. The system may further include a control panel, and the control panel may be connected to the controller and include a layout of nozzle indicators indicative of the positioning of the nozzles on the spray bar. The control panel may include one or more nozzle controls, and the nozzle controls may be coupled to sets of nozzles. The nozzle controls may be operable to activate or deactivate the delivery of emulsion fluid through the sets of nozzles. Each nozzle indicator may be operable to activate or deactivate the delivery of emulsion fluid through each individual nozzle. The controller may be configured to be coupled to a drive assembly of a paving machine to receive information regarding the speed or direction of the paving machine. The controller may be configured to automatically modify the spray pattern of the emulsion fluid from the nozzles by controlling the activation of individual nozzles based on the information received regarding speed or direction of the paving machine.

In a further aspect, a method of operating a paving machine may include activating a drive assembly of the paving machine, and the drive assembly may include at least one drive wheel, one or more idlers, and at least one track. The method may also include delivering an emulsion fluid to a ground surface, and the emulsion fluid may be stored in a tank on the paving machine. The tank may be fluidly coupled to at least one spray bar positioned between the at least one drive wheel and one or more idlers. The method may further include delivering paving material to the ground surface, and the paving material may be transferred from a hopper to a rear of the paving machine by a conveyor assembly. The paving material may be spread on the ground surface by one or more augers and a screed. The delivery of the emulsion fluid through the at least one spray bar may be controlled by a controller, and the controller may be connected to a control panel to indicate and receive user input to control the status of at least the delivery of the emulsion fluid through the nozzles. The control panel may be mounted on a portion of the screed.

The method may further include adjusting a spray pattern of the emulsion fluid from the spray bar based on the speed or direction of the drive assembly.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. In this disclosure, relative terms, such as, for example, "about," "substantially," and "approximately" are used to indicate a possible variation of ±10% in a stated value. Although the current disclosure is described with reference to a paving machine, this is only exemplary. In general, the current disclosure can be applied as to any machine, such as, for example, a paver finisher, asphalt finisher, or another paving-type machine.

Figure 1:
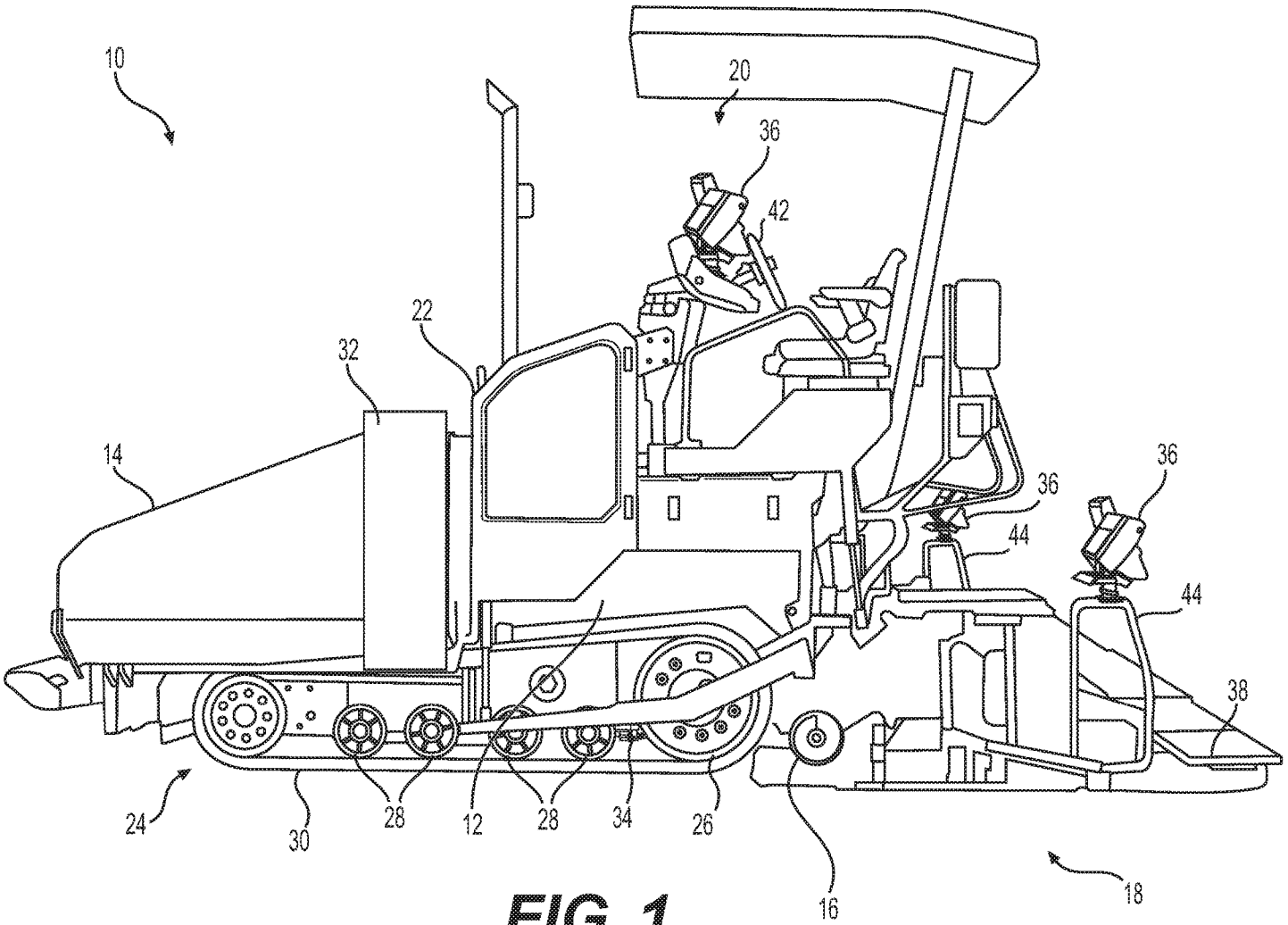
FIG. 1 is an illustration of an exemplary machine, according to aspects of this disclosure.

FIG. 1 illustrates a side view of an exemplary paving machine 10, according to the present disclosure. Machine 10 may be any size paver with any paving with. In one aspect, machine 10 may be a small paver, for example, with a maximum paving width of approximately 5.5 meters. Machine 10 includes a frame 12, a hopper 14, an auger 16, and a screed 18. Machine 10 may also include an operator station 20, from which an operator may maneuver and control machine 10. Machine 10 may be propelled by an engine assembly 22 to power a drive assembly 24, including a drive wheel 26, one or more idlers 28, and tracks 30. Additionally, machine 10 includes a tank 32 and a spray bar 34. Tank 32 may contain a treatment or emulsion fluid, for example, a binding material, to be delivered to the ground surface by spray bar 34 prior to delivery of the paving material via auger 16 and screed 18. Additionally, machine 10 includes one or more control panels 36, for example, positioned in operator station 20, in one or more operator positions 38 on screed 18, or remote from machine 10. Control panels 36 may control one or more aspects of machine 10 via controller 40 (FIG. 2).

Hopper 14 is positioned in a forward portion of frame 12 to receive or store the paving material, for example, from a mixer truck. Although not shown, a conveyor assembly connects hopper 14 to auger 16 in a rear portion of frame 12 to convey the paving material. The conveyor assembly may extend beneath tank 32, engine assembly 22, and operator station 20, and may be positioned above spray bar 34.

Auger 16 may be positioned perpendicular to the direction of travel of machine 10. Additionally, auger 16 may include a plurality of parallel or longitudinally arranged auger sections. Screed 18 is positioned to the rear of auger 16, and smooths the paving material delivered by auger 16 to the paving surface. The height of screed 18 may be adjustable, for example, via control panel 36. Operator station 20 may include a plurality of controls in order for an operator to steer machine 10, control a rate of delivery of the paving material, adjust the height of screed 18, etc.

Figure 2:
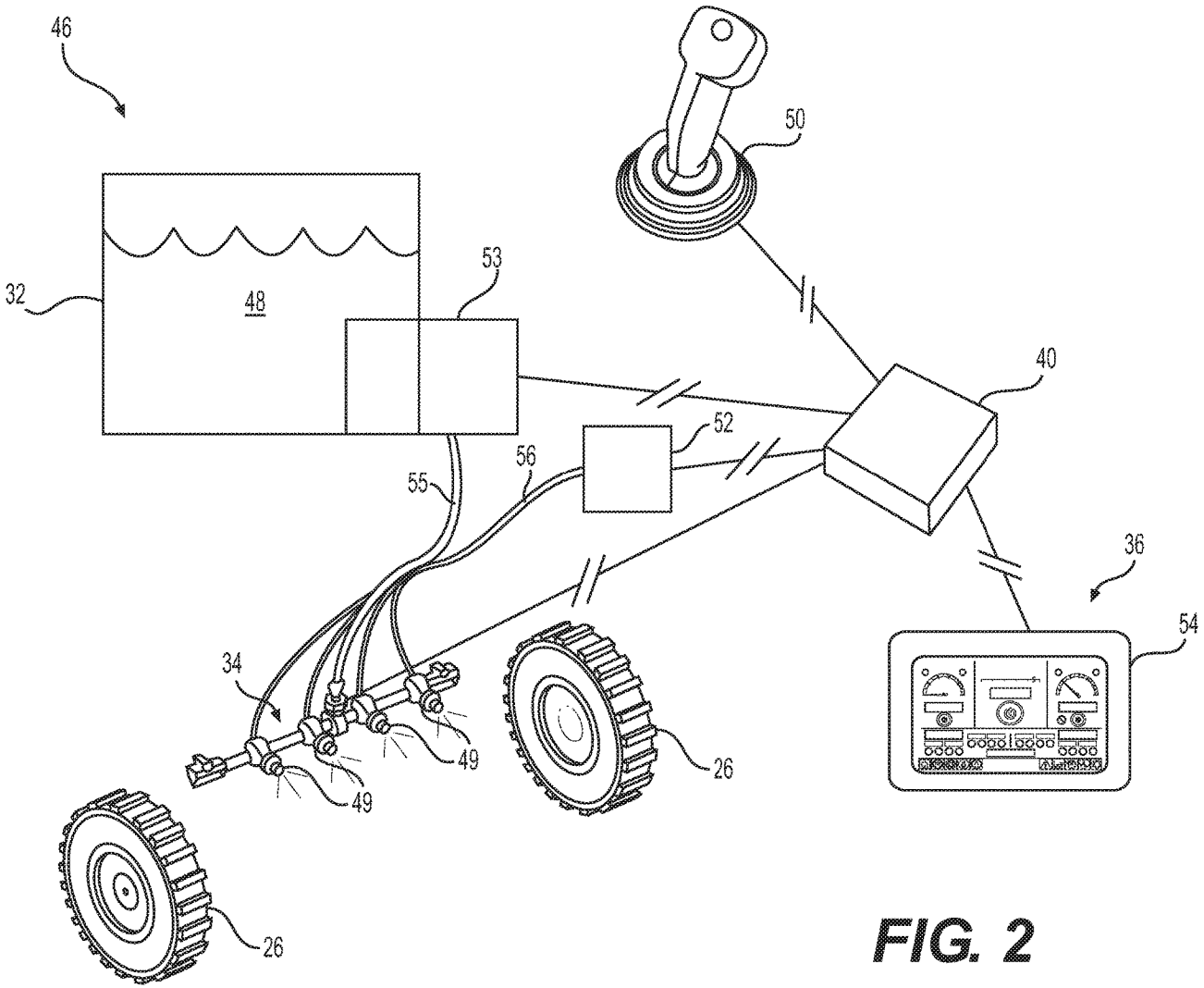
FIG. 2 is a schematic, exploded view of a portion of the exemplary machine of FIG. 1, according to aspects of this disclosure.

As shown in FIGS. 1 and 2, spray bar 34 may be positioned beneath a rear portion of frame 12, for example, below operator station 20. Spray bar 34 may extend a width of machine 10 between the drive wheels 26, idlers 28, and tracks 30. Moreover, machine 10 may include one or more additional spray bars or spray elements positioned to the rear of machine 10, for example, to the rear of tracks 30 and forward of auger 16 and screed 18, to spray the ground surface to the rear of tracks 30. Spray bar 34 and any additional spray elements may be fluidly coupled to tank 32 to deliver the emulsion fluid.

As noted above, the one or more control panels 36 may be mounted in operator station 20 and/or in operator positions 38 on screed 18. One control panel 36 may be positioned on a dashboard next to a steering wheel 42 in operator station 20. Additionally or alternatively, one or more control panels 36 may be mounted on one or more rails 44 at a rear portion of screed 18. An operator may stand on screed 18 at one of operator positions 38, for example, on a left and a right side of screed 18, and monitor, adjust, or otherwise control various functions of machine 10 via control panel 36 mounted on one of rails 44. Furthermore, a user may monitor, adjust, or otherwise control various functions of machine 10 via control panel 36 from a remote position. In one aspect, control panel 36 may be removably mounted, for example, via a clip, Velcro®, or other securing device, to one of rails 44 on screed 18 such that a user may operate control panel 36 from operator position 38, and may remove control panel 36 to then control aspects of machine 10 from a remote position.

FIG. 2 illustrates an exploded view of a portion of machine 10. Specifically, FIG. 2 shows an emulsion system 46 to control and deliver emulsion fluid 48 from tank 32 to spray bar 34 and nozzles 49. Emulsion system 46 may include control panel 36, controller 40, an input device 50, and a nozzle controller 52. Control panel 36, controller 40, input device 50, and nozzle controller 52 may be wired or wireless connected to each other.

Control panel 36 includes a control panel display 54 with a series of display and input options. Controller 40 may include a computer or computer readable memory storing computer executable instructions to control activation of emulsion system 46. Controller 40 may be configured to selectively control the delivery of emulsion fluid 48 from tank 32 by controlling a pump 53 coupled to spray bar 34 via one or more hoses 55. Additionally, controller 40 may be configured to receive data from one or more sensors, for example, temperature and volume sensors in tank 32, temperature and volume sensors on spray bar 34, and/or other sensors to detect or estimate the coverage of emulsion fluid 48 sprayed from nozzles 49 on spray bar 34 to the ground surface. Controller 40 may further be configured to receive user commands from input device 50 and control panels 36, and to be in communication with nozzle controller 52.

Input device 50 may be operable to control the delivery of emulsion fluid 48 by opening or closing one or more internal valves and/or by controlling the operation of pump 53, for example, via controller 40. Furthermore, the functions and capabilities of input device 50 may be combined into a touch screen user interface on control panel 36.

Nozzle controller 52 may be connected to each nozzle 49 via nozzle control connections 56 to operably control each nozzle 49. Nozzle controller 52 may selectively control the activation of each nozzle 49, for example, in response to user input via control panel 36. Nozzle controller 52 may control pneumatically controlled valves that may be electronically actuated or adjusted via control panel 36 to control the opening and the extent of opening of the valves to control the volume of emulsion fluid 48 through each nozzle 49. Although not shown, machine 10 includes tubes or hoses coupling nozzles 49 to a pneumatic fluid source. Alternatively, nozzle controller 52 may control hydraulically controlled valves within each nozzle 49. As mentioned, pump 53 may transfer or pressurize emulsion fluid 48 being delivered to spray bar 34 from tank 32. Spray bar 34 may include a central channel that carries emulsion fluid 48, and nozzle controller 52 may control the flow of emulsion fluid 48 from the central channel to each nozzle 49 by opening and closing valves within each nozzle 49. Nozzle controller 52 may thus control a spray width or pattern by opening, closing, or metering one or more internal valves to selectively deliver a desired flow of emulsion fluid 48 from select nozzles 49.

Whether remote from or attached to machine 10, control panel 36 may be used to adjust, control, activate, and otherwise monitor the flow rate or volume of emulsion fluid through each nozzle 49. For example, control panel 36 may be wired or wirelessly connected (e.g., via Bluetooth®, WiFi, or other connection protocol) to one or more sensors (e.g., in tank 32, within spray bar 34, etc.), pump 53, compressors, and nozzle controller 52. Control panel 36 may control the pressure and/or volume of emulsion fluid 48 delivered to spray bar 34 from tank 32. As discussed above, control panel 36, via controller 40 and nozzle controller 52, may also be used to control the flow of emulsion fluid 48 through each nozzle 49 by controlling the volume of emulsion fluid 48 delivered to spray bar 34, and also by controlling the opening of the internal vales within each nozzle 49. As such, a user may selectively control the flow of emulsion fluid 48 through each nozzle 49, and control the spray pattern emitted from spray bar 34. Additionally, control panel 36 may be wirelessly connected to one or more additional user devices, for example, a smartphone, tablet, or laptop, to allow a user to monitor and/or control the elements of machine 10 through control panel 36.

Figure 3:
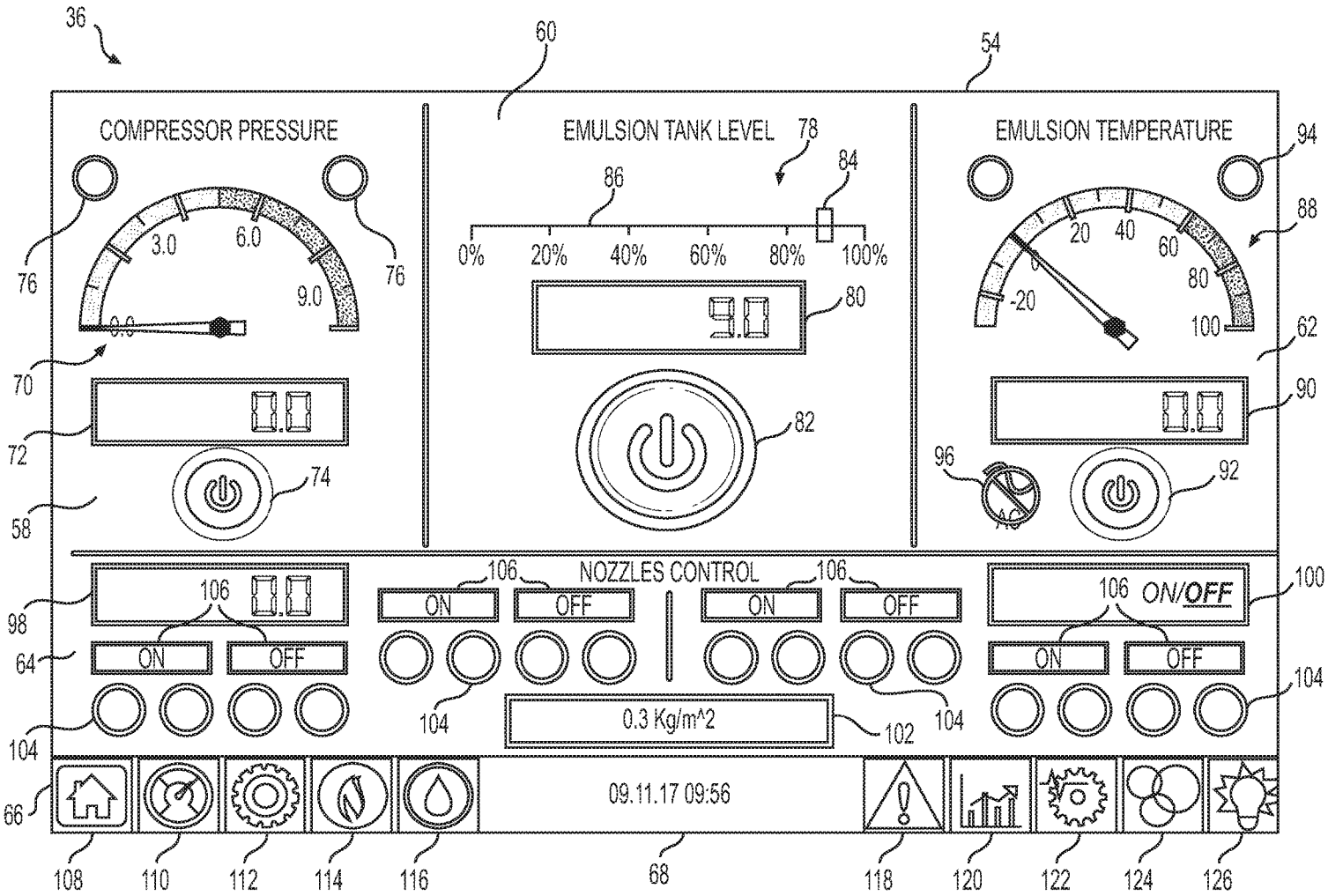
FIG. 3 is an illustration of an exemplary controller display, according to aspects of this disclosure.

FIG. 3 illustrates an exemplary control panel 36, including control panel display 54. Control panel display 54 may be a being a touch screen (e.g., an iPad®, tablet, etc.), or may instead include a display or a plurality of displays and one or more pushbuttons, switches, a keyboard, etc. Control panel display 54 displays a plurality of measured values, user input options, and other information to an operator of machine 10.

Control panel display 54 may include a home or default screen that displays a compressor pressure panel 58 indicative of a pressure within an air compressor (not shown). Control panel display 54 may also display an emulsion tank level panel 60 and an emulsion temperature panel 62. Control panel display 54 may further include a nozzle control panel 64 and one or more tool bars 66, including a plurality of input options, which may include accessing corresponding settings or actuation control screens. A date and time indicator 68 may also be displayed on control panel display 54, for example, as a part of tool bar 66. Furthermore, the configuration and arrangement of control panel display 54 may be customizable or otherwise vary based on user settings, machine 10, or type of paving operation.

The air compressor may be powered by engine assembly 22, and may be activated to deliver compressed air to nozzles 49 to either actuate nozzles 49 or to help spray or atomize the delivered emulsion fluid 48. Although not shown, the air compressor may be mounted on, positioned within, or otherwise coupled to machine 10 or a component of machine 10, and the air compressor may be fluidly connected to each nozzle 49. The air compressor may optionally be valved to hose 55, such that the compressed air may be delivered through at least a portion of emulsion system 46 to help clean the internal components of emulsion system 46. Compressor pressure panel 58 may include a pressure gauge 70, including a dial with indications and a needle, a pressure display 72, activation button 74, and one or more pressure status indicators 76. Pressure gauge 70 and pressure display 72 may indicate the pressure measured by one or more sensors within the air compressor. Alternatively, pressure display 72 may indicate a desired or programmed pressure, and pressure gauge 70 may indicate the measured pressure. Pressure gauge 70 and pressure display 72 may indicate pressure in bars, pascals, $N/m^2$, PSI, or any other appropriate pressure measurement, and may also include one or more indicators of unsafe pressures. Activation button 74 may be used to activate or deactivate the air compressor within machine 10, and pressure status indicators 76 may indicate a status of the air compressor by illuminating, changing color, etc. For example, with the air compressor inactive, pressure status indicators 76 may be grey, and with the air compressor active, pressure status indicators 76 may be green. Activation button 74 may also change color based on the status of the air compressor. In one aspect, the air compressor will be automatically activated when spray bar 34 and nozzles 49 are activated to deliver emulsion fluid 48, and action on activation button 74 will not affect the status of the air compressor. If spray bar 34 and nozzles 49 are not activated, then the user may optionally turn the air compressor on or off using activation button 74.

Emulsion tank level panel 60 may include an emulsion level indicator 78, an emulsion volume indicator 80, and an emulsion spray activation button 82. Emulsion level indicator 78 may indicate the level of emulsion fluid 48 as a percentage of tank 32 being 100% full, for example, with a marker 84 on a scale 86. Emulsion volume indicator 80 may digitally display a volume of emulsion fluid 48 within tank 32. Emulsion level indicator 78 and emulsion volume indicator 80 may be coupled to one or more sensors within tank 32, and may indicate the respective levels in liters, gallons, or another appropriate volume measurement. Emulsion spray activation button 82 may be used to activate or deactivate the delivery of emulsion from spray bar 34, for example, by opening one or more nozzles 49. Emulsion spray activation button 82 may change color based on the status of the emulsion delivery system. Activation of the emulsion delivery system through emulsion spray activation button 82 may also automatically activate the pumps or compressors, as well as one or more heaters within tank 32.

Emulsion temperature panel 62 may include a temperature gauge 88, including a dial with indications and a needle, a temperature indicator 90, a heating activation button 92, and one or more heater status indicators 94. Emulsion temperature panel 62 may also include an AC voltage availability indicator 96. Temperature gauge 88 may indicate the temperature measured by one or more sensors within tank 32, spray bar 34, or one of the hoses connecting tank 32 to spray bar 34. Temperature indicator 90 may digitally display a temperature within tank 32, spray bar 34, or one of the hoses connecting tank 32 to spray bar 34. Temperature gauge 88 and temperature indicator 90 may display the temperature in the same portion of machine 10, or may be operably coupled to different sensors positioned in different portions of machine 10, for example, one in tank 32 and one in spray bar 34. Temperature gauge 88 and temperature indicator 90 may indicate pressure in Celsius or Fahrenheit, and may include indicators of unsafe temperatures. Heating activation button 92 may be used to activate or deactivate one or more resistor heaters positioned within tank 32, and heater status indicators 94 may indicate the operational status of respective heaters or sets of heaters within tank 32. Heater status indicators 94 may illuminate, change color, etc. to indicate a status of the heaters. For example, with the heaters inactive, heater status indicators 94 may be grey, and with the heaters active, heater status indicators 94 may be green. Heating activation button 92 may also change color based on the status of the heaters. In one aspect, the heaters will be automatically activated when spray bar 34 and nozzles 49 are activated to deliver emulsion fluid 48, and action on heating activation button 92 will not affect the status of the heaters. If spray bar 34 and nozzles 49 are not activated, then the user may optionally turn the heaters on or off using heating activation button 92. Moreover, control panel display 54 may present an option to selectively activate one or a subset of the heaters within tank 32. AC voltage availability indicator 96 may indicate to an operator whether machine 10 is currently producing sufficient alternating current voltage to power the heaters within tank 32, which may correspond to a status of engine assembly 22.

Nozzle control panel 64 may include a spray bar pressure indicator 98, an emulsion pump status indicator 100, an emulsion flow rate indicator 102, a plurality of nozzle indicators 104, and nozzle controls 106. It is noted, however, that nozzle control panel 64 may alternatively include a subset of the aforementioned indicators and controls. Emulsion spray bar pressure indicator 98 may be coupled to a sensor within emulsion spray bar 34 and indicate the pressure within emulsion spray bar 34. Emulsion pump status indicator 100 may indicate the status and/or functioning of an emulsion pump within machine 10, for example, pump 53 delivering emulsion fluid 48 from tank 32 to emulsion spray bar 34. Emulsion pump status indicator 100 may indicate whether pump 53 is on or off, may indicate an operational status, or warnings. Emulsion flow rate indicator 102 may indicate a volumetric flow of emulsion fluid 48 delivered by machine 10 to the ground surface. The volumetric flow may be presented as relative to an area, a time, or another measurement. Additionally, emulsion flow rate indicator 102 may include one or more selectable buttons or actuators that a user may use to increase, decrease, or otherwise adjust the emulsion flow rate.

Nozzle indicators 104 may illuminate or change color to indicate the operational status of individual nozzles or sets of nozzles, for example, nozzles 49 positioned on spray bar 34. The configuration of nozzle indicators 104 on control panel display 54 may correspond to or be indicative of the relative positioning of nozzles 48 along spray bar 34, the additional spray bars or spray elements, or along a width of machine 10. Nozzle controls 106 may allow a user to control a set of nozzle indicators 104, which may correspond to four nozzles 49, by activating the set "ON" or turning the set "OFF," for example, by selectively depressing or touching the "ON" or "OFF" buttons or icons. Alternatively or additionally, nozzle indicators 104 may be separately controllable to activate or deactivate individual nozzles 49. In one aspect, nozzle indicators 104 may be pushbuttons, individual switches, or icons to control each nozzle 49. For example, during a paving operation, a user may activate the delivery of emulsion fluid by activating emulsion spray activation button 82. The user may then activate or deactivate a particular set of nozzles 49 via action on the appropriate nozzle control 106. The user may alternatively or additionally activate or deactivate individual nozzles 49 via action on individual nozzle indicators 104.

Tool bar 66 may include a plurality of input options and indicators. The input options may allow a user to enter different display modes and/or make adjustments to the settings of machine 10. Tool bar 66 may include a home button 108, which may be selectable to return to the "home screen" displayed on control panel display 54 in FIG. 3. Tool bar 66 may also include a sensor data button 110, which may allow a user to view data from a plurality of temperature and pressure sensors positioned throughout the emulsion delivery system, for example, in tank 32, spray bar 34, heaters, pump 53, and engine assembly 22. Sensor data button 110 may also allow the user to view additional data including, for example, rotations per minute of a motor, compressor, pump 53, the vibration or tamper of screed 18, the left and right extension of screed 18, and the speed of machine 10 and respective drive assemblies 24.

Tool bar 66 may include a settings button 112, which may allow a user to view, program, or adjust preset values of the emulsion flow rate, pump pressures, heater settings, and nozzle pressure settings. Settings button 112 may allow a user to set or adjust the date and time displayed by date and time 68 on control panel display 54. Settings button 112 may also allow the user to change the displayed language or units of measurement, which may then be saved as the default settings.

Tool bar 66 may include an emulsion temperature control button 114 and an emulsion pump control button 116. Emulsion temperature control button 114 may allow a user to view, program, or adjust preset values of the emulsion temperature in tank 32 selectively controllable with resistor heaters in tank 32. For example, a user may view the operational status, view the current temperature, adjust the set temperature, and activate each of the individual resistor heaters. Emulsion temperature control button 114 may also allow the user to view the temperature of emulsion fluid 48 in tank 32, such that the user may adjust the settings for the heaters based on the current measured temperature of emulsion fluid 48 or an ambient temperature outside of machine 10. Emulsion pump control button 116 may allow a user to view, program, or adjust preset values of the pumps in machine 10, or to activate or deactivate the pumps in machine 10. For example, emulsion pump control button 116 may also allow a user to view or adjust the pump settings, pump pressure, etc. Emulsion pump control button 116 may allow a user to program pump 53 or an additional pump to refill tank 32 from an external source, recirculate emulsion fluid 48 within tank 32, empty emulsion fluid 48 from tank 32, or recirculate emulsion fluid 48 within spray bar 34 back into tank 32.

Tool bar 66 may further include an alarm button 118 and a statistics button 120. Alarm button 118 may be selectable for a user to view any current or previous errors or potential issues with machine 10. If an error occurs, alarm button 118 may flash, change color, or otherwise indicate an issue to the user. Statistics button 120 may allow a user to view one or more statistics or information for machine 10 including, for example, working hours, paving hours, traveled distance, paved distance, amount of emulsion sprayed, paved area, etc. The aforementioned statistics or information may include total amounts and partial amounts, for example, the resettable amounts of each measured value.

Tool bar 66 may also include a nozzle calibration button 122 and a cleaning activation button 124. Nozzle calibration button 122 may allow a user to test individual nozzles 49 and calibrate the entire spray system for machine 10, for example, to test the nozzles 49 to measure a spray width and a spray length for individual nozzles 49 or for all of the nozzles 49 in combination. Nozzle calibration button 122 may allow a user to program spray intervals or continuous spray settings for different nozzles 49 to deliver different spray patterns. Additionally, nozzle calibration button 122 may allow a user to simulate the delivery of emulsion fluid 48 through spray bar 34 without moving machine 10 or delivering paving material and display a simulated spray pattern. Cleaning activation button 124 may provide the user with the option to initiate a cleaning function to cleanse or flush the spray system, for example, by a pump or compressor pumping air or another fluid through pump 53 and out of nozzles 49 on spray bar 34 to ensure that any liquid within the elements is dispelled. In one aspect, cleaning activation button 124 may be operable to pump a cleaning solution from a cleaning solution tank on machine 10 through pump 53 and out of nozzles 49 on spray bar 34. The cleaning function may be automatically initiated when machine 10 is not active for a period of time, and the period of time may be user-programmable. Alternatively, the cleaning function may be user-initiated via cleaning activation button 124.

Lastly, tool bar 66 may include a display illumination button 126. Display illumination button 126 may allow a user to activate a backlight or otherwise adjust the brightness of control panel display 54. Although not shown, control panel 36 may also include one or more ON/OFF/Sleep buttons or switches to control the activation of control panel display 54.

Figure 4:
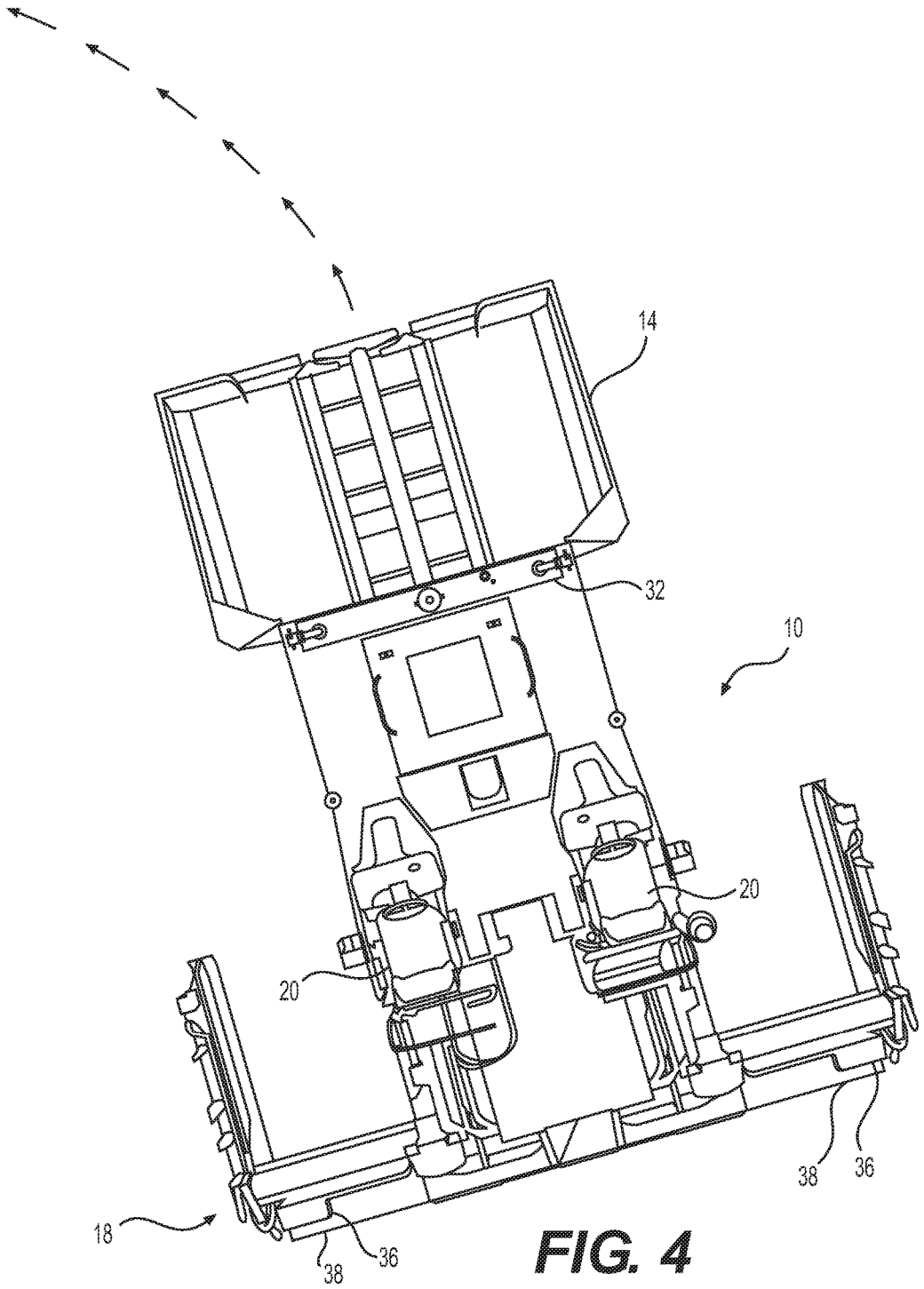
FIG. 4 is a perspective view of the exemplary machine of FIG. 1 in motion, according to aspects of this disclosure.

FIG. 4 illustrates a top view of machine 10 in motion. As shown, machine 10 may make turns by adjusting the speeds of drive assemblies 24 (FIG. 1). For example, to turn left, drive assembly 24 on a right side of machine 10 may be set to a higher speed than drive assembly 24 on a left side of machine 10. As the different sides of machine 10 advance at different speeds, a user may adjust the delivery of emulsion fluid 48 through nozzles 49 on spray bar 34. For example, as discussed above, the user may selectively activate, deactivate, or adjust the amount of emulsion fluid 48 through each nozzle 49 or a set of nozzles 49 through action on nozzles controls 106 and/or nozzle indicators 104. A user may activate the delivery of emulsion fluid 48 by activating emulsion spray activation button 82. The user may then activate or deactivate a particular set of nozzles 49 via action on the appropriate nozzle control 106, and/or the user may activate or deactivate individual nozzles 49 via action on individual nozzle indicators 104.

In one aspect, if machine 10 is turning left or right, controller 40 may calculate the average speed of the left and right tracks. Using the average speeds, controller 40 may control nozzles 49 on the left and right sides of machine 10 in order to deliver a proper volume of emulsion fluid 48 through nozzles 49. For example, if turning left, controller 40 may control nozzles 49 such that nozzles 49 on a right side of machine 10 deliver a greater volume of emulsion fluid 48 than nozzles 49 on a left side of machine 10 in order to evenly cover the ground surface with a constant volume of emulsion fluid 48 during the turn. Such adjustment may be made via control panel display 54, with the user standing on operator position 38 and operating control panel 36. Alternatively or additionally, such adjustment may be made automatically with controller 40 connected to steering wheel 42 and/or other components of drive assembly 24. Furthermore, the adjustment may include activating and deactivating individual nozzles 49, and/or various spray sequences from nozzles 49 or a subset of nozzles 49. Nozzles 49 may also be controlled by controller 40 to automatically be activated or deactivated based on or corresponding to the movement of machine 10. For example, if machine 10 is stopped, nozzles 49 be deactivated, and if machine 10 is moving, nozzles 49 may be activated.

Although not shown, screed 18 may be selectively extendable in the left and right directions. Controller 40 may be operably coupled to a screed controller such that controller 40 may adjust the spray pattern from nozzles 49 based on the extension of screed 18. For example, if screed 18 is extended in the right direction, controller 40 may adjust nozzles 49 on a right side of spray bar 34 to deliver a greater amount of emulsion fluid 48, and may also reduce the amount of emulsion fluid delivered from nozzles 49 on a left side of spray bar 34. Such configurations may also be displayed on control panel display 54, and may be user adjustable as discussed above with respect to nozzle indicators 104 and/or nozzle controls 106.

INDUSTRIAL APPLICABILITY

The disclosed aspects of machine 10 may be used in any paving machine to assist in delivery of paving material. During operation, spray bar 34 may deliver emulsion fluid 48 to the ground surface traversed by machine 10. The position of spray bar 34 may help to allow for the delivery of emulsion fluid 48 to coat the ground surface before the paving material is delivered, and thus help to ensure a proper binding of the paving material with the ground surface. For example, spray bar 34 may be positioned between drive wheel 26 and one or more idlers 28. As such, spray bar 34 may deliver emulsion fluid 48 to the ground surface in proximity to auger 16 and screed 18, which may help to ensure that the density, consistency, temperature, and other properties of the delivered emulsion fluid do not substantially change between the delivery and the time emulsion fluid 48 is covered with paving material. The position and control of spray bar 34 may also help to ensure that tracks 30 do not pass through the delivered emulsion fluid even while machine 10 is turning.

Additionally, the delivery of emulsion fluid 48 through spray bar 34 may be programmable or selectively adjustable via control panel display 54 of control panel 36, either from a position on machine 10 (e.g., operator station 20 or operator position 38), or from a remote location. In one aspect, machine 10 may include a plurality of control panels 36 coupled to different portions of machine 10 to allow a user to monitor and control the emulsion delivery from the different positions. Furthermore, one or more additional user devices, for example, a smartphone, tablet, or laptop, may be wirelessly coupled to control panel 36 to allow a user to monitor and control the delivery of emulsion fluid from a position remote to machine 10. As such, a user may control nozzle controllers 48 and adjust the spray pattern produced by nozzles 49 in real-time during a paving procedure.

As shown in FIG. 4, for example, as machine 10 is making a turn, control panel 36 may be used to increase amount of emulsion fluid 48 delivered on one side or portion of machine 10, and to reduce the amount of emulsion fluid 48 delivered on another side or portion of machine 10. Control panel 36 may also allow a user to control individual nozzles 48 in order to modify the spray width or spray pattern from spray bar 34. Based on the positioning of a plurality of nozzles 49 on spray bar 34 and on additional spray bars or spray elements, control panel 36 may allow a user to adjust and control the spray width or spray pattern for machine 10, allowing machine 10 to be used with a variety of screed widths to create different paving widths.

The disclosed aspects of machine 10 also allow a user to monitor and adjust the various elements of machine 10, including those elements that deliver emulsion fluid 48, from either a position on machine 10 or from a remote position. For example, a user may monitor and adjust the pressure and temperature of emulsion fluid 48 in tank 32 on control panel display 54 and the various tools in tool bar 66. In one aspect, the user may increase the temperature of emulsion fluid 48 by increasing the current through the resistor heaters in tank 32. In another aspect, the user may increase the pressure or volume of emulsion fluid 48 delivered by nozzles 49 if, for example, machine 10 is moving and paving at a greater speed. If, for example, machine 10 begins to pave at a lower speed, then the user may decrease the pressure or volume of emulsion fluid 48 delivered by nozzles 49 to help to avoid oversaturating the ground surface. In an additional aspect, a user may pre-program a correlation between the pressure, flow rate, and direction of nozzles 49 with the speed and travel direction of machine 10 and in order to help ensure the deliver of a proper amount of emulsion fluid to the ground surface.

It will be apparent to those skilled in the art that various modifications and variations can be made to the disclosed machine without departing from the scope of the disclosure. Other embodiments of the machine will be apparent to those skilled in the art from consideration of the specification and practice of the control system for a paving machine disclosed herein. It is intended that the specification and examples be considered as exemplary only, with a true scope of the disclosure being indicated by the following claims and their equivalents.

What is claimed is:

1. A paving system, comprising a paving machine, including a machine frame;

a drive assembly, a paving material delivery assembly, including a hopper, a conveyor assembly, an auger, and a screed;

an emulsion fluid delivery assembly, including a tank of emulsion fluid and a spray bar including a plurality of nozzles; and a controller and a control panel, wherein the controller is wired or wirelessly coupled to the tank and the spray bar to control at least one of a temperature or a pressure of the emulsion fluid through the nozzles, and wherein the controller is connected to the drive assembly of the paving machine to receive information regarding a direction of the paving machine, and wherein the controller is configured to automatically modify a spray pattern of the emulsion fluid by controlling the activation of individual nozzles based on the information received regarding the direction of the paving machine.

2. The paving system of claim 1, wherein the spray bar is positioned on an underside of the machine frame between at least two tracks and fluidly coupled to the tank to deliver the emulsion fluid to a ground surface.

3. The paving system of claim 1, wherein each nozzle is coupled to a nozzle controller, and wherein each nozzle controller is wired or wirelessly coupled to the controller to control the opening and closing of a valve in each nozzle to control the delivery of emulsion fluid through each nozzle.

4. The paving system of claim 1, wherein the controller is operably coupled to one or more sensors within the emulsion fluid delivery assembly in order to measure and display at least one of a compressor pressure, an emulsion tank level, or a temperature of the emulsion fluid in the tank, and wherein the controller is configured to indicate unsafe pressures, temperatures, or other conditions on the control panel based on the measurements of the one or more sensors.

5. The paving machine of claim 1, further including:

a supply of cleaning fluid, wherein the controller is operable to control the delivery of the cleaning fluid through the emulsion fluid delivery assembly; and an air compressor, wherein the controller is operable to control the delivery of compressed air to the nozzles or through the emulsion fluid delivery assembly.

6. The paving system of claim 1, further including one or more heaters positioned within the tank, and wherein the controller is operable to control the activation of the one or more heaters.

7. The paving system of claim 6, further including one or more pumps positioned at least partially within the tank to control the delivery of the emulsion fluid, and wherein the controller is operable to control the activation of the one or more pumps.

8. The paving system of claim 1, further including one or more spray elements positioned on the machine frame, wherein the spray elements are positioned between tracks and the auger, and wherein the one or more spray elements are fluidly connected to the tank.

9. The paving system of claim 8, wherein the control panel includes a layout of nozzle indicators indicative of the positioning of the nozzles on the spray bar and the spray elements.

10. The paving system of claim 9, wherein the control panel includes one or more nozzle controls, wherein the nozzle controls are coupled to sets of nozzles and spray elements, and wherein the nozzle controls are operable to activate or deactivate the delivery of emulsion fluid through the sets of nozzles and spray elements.

11. The paving system of claim 10, wherein each nozzle indicator is operable to activate or deactivate the delivery of emulsion fluid through each individual nozzle and spray element.

12. The paving system of claim 9, wherein the controller is coupled to the drive assembly of the paving machine to receive information regarding a speed of the paving machine, and wherein the controller is configured to automatically modify the spray pattern of the emulsion fluid by controlling the activation of individual nozzles based on the information received regarding speed of the paving machine.

13. The paving machine of claim 1, wherein the control panel is mounted to a rear of the machine frame and is positioned at an operator position on the screed.

14. The paving machine of claim 13, wherein the control panel is removably mounted on the machine frame.

15. An emulsion fluid delivery and control system for a paving machine, comprising a tank of emulsion fluid, including at least one pump and one or more heaters;

a spray bar fluidly connected to the tank and including a plurality of nozzles, wherein the nozzles are coupled to a nozzle controller and include a pneumatically controlled valve;

a controller, wherein the controller is wired or wirelessly coupled to the tank to control at least one of a temperature, pressure, or delivery rate of the emulsion fluid to the spray bar, and wherein the controller is wired or wirelessly coupled to the plurality of nozzles to control the activation and deactivation of each nozzle; and a control panel that is connected to the controller and includes a plurality of nozzle indicators, wherein each nozzle indicator is coupled to a respective nozzle, wherein the control panel includes one or more nozzle controls, wherein the nozzle controls are coupled to sets of nozzles, and wherein the nozzle controls are operable to activate or deactivate the delivery of emulsion fluid through the sets of nozzles, and wherein each nozzle indicator is operable to activate or deactivate the delivery of emulsion fluid through each respective nozzle.

16. The system of claim 15, wherein the control panel includes a layout of the nozzle indicators indicative of the positioning of the respective nozzles on the spray bar.

17. The system of claim 15, wherein the controller is configured to be coupled to a drive assembly of the paving machine to receive information regarding a speed or a direction of the paving machine, and wherein the controller is configured to automatically modify the spray pattern of the emulsion fluid from the nozzles by controlling the activation of individual nozzles based on the information received regarding speed or direction of the paving machine.

18. The system of claim 15, wherein the controller is operably coupled to one or more sensors in order to measure and display at least one of a pump pressure, an emulsion tank level, or a temperature of the emulsion fluid in the tank, and wherein the controller is configured to indicate unsafe pressures, temperatures, or other conditions on the control panel based on the measurements of the one or more sensors.

19. A method of operating a paving machine, comprising:

activating a drive assembly of the paving machine, wherein the drive assembly includes at least one drive wheel, one or more idlers, and at least one track;

delivering an emulsion fluid to a ground surface, wherein the emulsion fluid is stored in a tank on the paving machine, and wherein the tank is fluidly coupled to at least one spray bar positioned between the at least one drive wheel and one or more idlers; and delivering paving material to the ground surface, wherein the paving material is transferred from a hopper to a rear of the paving machine by a conveyor assembly, and wherein the paving material is spread on the ground surface by one or more augers and a screed, wherein the delivery of the emulsion fluid through the at least one spray bar is controlled by a controller, wherein the controller is connected to a control panel to indicate and receive user input to control the status of at least the delivery of the emulsion fluid through the nozzles, wherein the controller is connected to the drive assembly to receive information regarding a direction of the paving machine, and wherein the controller is configured to automatically modify the spray pattern of the emulsion fluid by controlling the activation of nozzles based on the received information regarding the direction of the paving machine.

20. The method of claim 19, further including controlling the delivery of emulsion fluid through one or more sets of nozzles via one or more nozzle controls on the control panel, and controlling the delivery of emulsion fluid through individual nozzles via respective nozzle indicators.

* * * * *